United States Patent [19]

Campbell et al.

[11] Patent Number: 5,037,031

[45] Date of Patent: Aug. 6, 1991

[54] REDUCED TRAPPED VOLUME

[75] Inventors: Jeffery L. Campbell, Hope; Lester L. Peters, Columbus; Gary L. Gant, Columbus; Leslie A. Roettgen, Columbus; David P. Genter, Columbus; Kevin R. Wadell, Columbus, all of Ind.

[73] Assignee: Cummins Engine Company, Inc., Columbus, Ind.

[21] Appl. No.: 514,431

[22] Filed: Apr. 25, 1990

[51] Int. Cl.[5] ..... F02M 47/02

[52] U.S. Cl. ..... 239/533.3

[58] Field of Search ..... 239/533.1–533.3, 239/533.9, 585

[56] References Cited

U.S. PATENT DOCUMENTS 3,836,080 9/1974 Butterfield et al. .
4,213,568 7/1980 Hofmann .
4,280,659 7/1981 Gaal et al. .
4,523,719 6/1985 Hofmann .
4,601,086 7/1986 Gerlach .

*Primary Examiner*—Andres Kashnikow
*Assistant Examiner*—Lesley D. Morris
*Attorney, Agent, or Firm*—Sixbey, Friedman, Leedom & Ferguson

[57] ABSTRACT

The present invention is directed to open nozzle type unit fuel injectors, and more specifically to an improved lower plunger and cup design of an open nozzle unit injector to minimize trapped volume and reduce unburned hydrocarbons in vehicle emissions. The lower plunger includes at least a major and a minor diameter sections with the minor diameter section extending within a bore of said cup at least partially between the fully advanced and retracted positions of the plunger. Moreover, the labyrinth flow area between the cup bore and the minor diameter section of the plunger is designed to reduce the trapped volume of fuel that results in the advanced plunger position while reducing sensitivity to fuel metering in the retracted plunger position. In one embodiment, the cup bore and minor diameter section are stepped. In another, both the bore and the minor diameter section are tapered. In yet another embodiment, only the cup bore is modified.

27 Claims, 9 Drawing Sheets

REDUCED TRAPPED VOLUME

TECHNICAL FIELD

This invention relates to unit fuel injectors, and in particular, to unit fuel injectors of the "open nozzle" type wherein fuel is metered into a metering chamber and is injected through injection orifices at the tip of the injector by a reciprocating plunger, and the metering chamber is provided at the injector tip and is open to an engine cylinder through the injection orifices during metering.

BACKGROUND OF THE INVENTION

Heretofore, various type fuel injectors and fuel injection systems have been known in the prior art which are applicable to internal combustion engines. Of the many types of fuel injection systems, the present invention is directed to unit fuel injectors, wherein a unit fuel injector is associated with each cylinder of an internal combustion engine and each unit injector includes its own drive train to inject fuel into each cylinder on a cyclic basis. Normally, the drive train of each unit injector is driven from a rotary mounted camshaft operatively driven from the engine crankshaft for synchronously controlling each unit injector independently and in accordance with the engine firing order.

Of the known unit injectors of such fuel injection systems, there are two basic types of unit injectors which are characterized according to how the fuel is metered and injected. A first type to which the present invention is oriented is known as an "open nozzle" fuel injector because fuel is metered to a metering chamber within the unit injector where the metering chamber is open to the engine cylinder by way of injection orifices during fuel metering.

In contrast to the open nozzle type fuel injector, there are also unit fuel injectors classified as "closed nozzle" fuel injectors, wherein fuel is metered to a metering chamber within the unit injector while the metering chamber is closed to the cylinder of an internal combustion engine by a valve mechanism that is opened only during injection by the increasing fuel pressure acting thereon. Typically, the valve mechanism is a needle type valve.

In either case, the unit injector typically includes a plunger element that strikes the metered quantity of fuel to increase the pressure of the metered fuel and force the metered fuel into the cylinder of the internal combustion engine. In the case of a closed nozzle injector, a tip valve mechanism is provided for closing the injection orifices during metering wherein the tip valve is biased toward its closed position to insure that injection will take place only after the fuel pressure is increased sufficiently to open the tip valve mechanism.

The present invention is directed to the open nozzle type fuel injector, and more specifically to a unit injector fuel injection system that relies on pressure and time principles for determining the quantity of fuel metered for each subsequent injection of each injector cycle. Moreover, the pressure time principles allow the metered quantity to be varied for each cyclic operation of the injector as determined by the pressure of the fuel supplied to the metering chamber and the time duration that such metering takes place.

Examples of unit injectors of the open nozzle type are described in detail in U.S. Pat. Nos. 4,280,659 and 4,601,086 to Gaal et al. and Gerlach, respectively, both of which are owned by the assignee of the present invention. The injectors of Gaal et al. and Gerlach include a plunger assembly with a lower portion having a major diameter section that is slidable within an axial bore of the injector body and a smaller minor diameter section that extends within a cup of the injector body. The cup provides an extension to the axial bore which is smaller in diameter than the diameter of the axial bore that passes through the remainder of the injector body. During the metering stage of the Gaal et al. and Gerlach injectors, fuel is metered through a supply port into the axial bore at a point above the cup, and the fuel flows around the minor diameter section of the plunger assembly at the tip thereof thus metering a specified quantity of fuel into the metering chamber of the cup. A radial gap is provided between the minor diameter section of the plunger assembly and the inner wall of the bore within the cup. This gap facilitates the flow of fuel to the injector tip to be injected. Once the metering stage is completed, the plunger travels inwardly (defined as toward the engine cylinder of an internal combustion engine) so as to cause injection of the fuel from the metering chamber through the injection orifices.

The stage just after the fuel injection has been completed is known as the crush stage, wherein the plunger tip is held tightly against a seat of the cup by the associated drive train for the unit fuel injector. During this crush stage, fuel is trapped within the radial gap between the minor diameter section of the plunger and the inner wall of the bore within the cup. This quality of fuel is known as the trapped volume.

It has been found by the inventors of the present invention that this trapped volume results in the presence of higher levels of unwanted emissions, particularly unburned hydrocarbons. Moreover, the undesirable hydrocarbon emissions associated with open nozzle injectors have been found to be a function of the trapped volume within the nozzle, wherein excess volume increases the level of the unburned hydrocarbons. The increase in unburned hydrocarbons found in the emissions is due to the tendency of the fuel within the trapped volume to migrate into the engine cylinder after the combustion in the cylinder to be exhausted therefrom. Furthermore, the major component of the trapped volume results from the gap between the minor diameter section of the plunger and the inner wall of the cup. The area of this gap is commonly referred to as the labyrinth seal clearance region of the fuel injector.

As can be understood from the above, such a problem is unique to open nozzle type fuel injectors because closed nozzle fuel injectors rely on a valve mechanism to seal the fuel from the engine cylinder at all times except during injection. Moreover, open nozzle injectors must allow the metering of fuel within the nozzle tip with injection orifices that are open to the engine cylinder.

Thus, in order to reduce the trapped volume surrounding the minor diameter section of the plunger within the cup after injection, the only solution suggested by the prior art technology is to simply reduce the radial gap between the minor diameter section of the plunger and the cup to thus reduce the trapped volume after injection is completed. However, such a modification becomes unacceptable and results in the problem that there is no longer a sufficient gap for the fuel to be metered into the nozzle area of the cup since the fuel flow around the minor diameter section of the plunger becomes significantly reduced as the gap is reduced. Specifically, it has been found that the quantity of metered fuel to be injected is reduced to a degree that insufficient fuel is injected. Therefore, such a solution is impractical and unacceptable.

To make the situation worse, the components of the injector, specifically the plunger minor diameter section and the inner surface of the bore within the cup, become carboned during the usage of the unit fuel injector in an internal combustion engine from hot gases within the engine cylinder that are forced back into the injector. Furthermore, as carbon builds up on the minor diameter section of the plunger and the inner wall of the cup, the gap between the minor diameter section and the cup inner wall is effectively reduced during use. Thus, the effect of carboning on the injector elements tends to urge a designer to make the injector with a greater gap between the minor diameter section of the plunger and the inner wall of the cup so that even after carboning, sufficient flow can be provided through the gap for adequate fuel metering.

It is clear from the above that the known teachings to reduce trapped volume and to permit fuel metering without effect from injector carboning are in direct conflict with each other. In other words, reducing the trapped volume teaches decreasing the gap between the minor diameter of the plunger and the cup inner wall, while reducing the sensitivity to fuel metering after carboning requires the increase in gap size. The end result of the known open nozzle type unit fuel injector technology is that the above noted goals must be balanced with one another to provide a compromised open nozzle type unit fuel injector that has a gap that partially achieves both goals. Thus, it can be seen that such open nozzle fuel injectors are absolutely limited in their ability to reduce engine emissions while permitting adequate and effective fuel metering.

Another serious problem that is unique to open nozzle-type unit fuel injectors is the sensitivity of fuel metering to carboning of the unit fuel injector. Injector carboning occurs on all of the surfaces of the minor diameter section of the plunger and the inner surface of the cup. As best understood, the carbon forms as a result of essentially oil, fuel, and the temperature in the unit injector metering chamber. Moreover, carboning occurs during certain engine operating conditions wherein little or no fuel is present in the metering chamber. Such conditions include a motoring condition where the engine is being driven from the vehicle drive train. The lack of fuel in the metering chamber during a condition such as motoring allows the gas temperatures inside the metering chamber to become very high. As a result, when the plunger tip unseats from the cup, airborne carbon enters the metering chamber from the engine combustion chamber through the injector spray holes. This airborne carbon then deposits on to the surfaces of the plunger and cup. A study of the carbon deposits on the plunger and cup has shown that, in cross section, a first layer of deposits on the surfaces is related to fuel and acts as a kind of adhesive. The outer layer consists of hard black carbon deposits which result mostly from oil. This outermost layer of deposits is responsible for creating another major problem of open nozzle-type unit injectors in that the deposits create injector flow loss which inhibits the flow of fuel into the metering chamber during metering.

During metering, fuel must pass between the minor diameter section of the plunger and the inner wall of the cup to flow to the metering chamber at the cup tip. As the carbon deposits increase in thickness, the flow loss also increases. At some point it becomes impossible to obtain a sufficient fuel flow between the plunger minor diameter section and the cup inner wall such that a sufficient volume of metered fuel is created for injection. At this point, the unit injector cannot function properly.

Thus, in order to deal with the carboning situation, it has become necessary to replace, or at least service, such open nozzle unit fuel injectors after a period of running time, depending on operating conditions. As an alternative, efforts have been concentrated on reducing the formation of carboning as a means of lessening the effect of carboning on injector flow metering. However, once carboning eventually builds up, the injector will inevitably experience some injector flow loss.

For the above reasons, the popularity of closed nozzle fuel injectors has increased; however, the immediate disadvantage associated with closed nozzle fuel injectors is the extra costs that are associated with the production of such substantially more complex unit fuel injectors. Apart from the fact that a closed nozzle unit fuel injector functions on different operational principles than an open nozzle injector, as amplified above, closed nozzle injectors do not experience the same problems of open nozzle injectors enumerated above. Specifically, the valve of the closed nozzle injector does not have to be designed to accommodate precise metering at the nozzle while attempting to reduce trapped volumes. The only trapped volume that results within a closed nozzle type injector lies underneath a tip of a spring loaded nozzle valve just adjacent its injection orifices. Furthermore, injector carboning is not as prevalent in closed nozzle unit fuel injectors because the nozzle valve effectively closes the metering chamber to the engine combustion chamber during motoring or the like conditions.

An example of a closed nozzle fuel injector that specifically attempts to reduce the volume under the tip of the nozzle valve, noted as the SAC volume, is described in U.S. Pat. No. 4,106,702 to Gardner et al. In the Gardner device the tip of the nozzle valve is specifically tapered in a manner to reduce the SAC volume at the injection openings of the nozzle tip and to design the valve tip to seat against the interior conical surface of the nozzle. Although the Gardner et al. device is designed to reduce an SAC volume and reduce engine emissions related thereto, the closed nozzle type injector does not concern itself with reducing trapped volume in an environment that further must accommodate any metering of fuel for injection, since the nozzle valve simply reacts to the pressure of previously metered fuel and does not affect the metering of the injected fuel.

Other closed nozzle type fuel injectors including specifically designed nozzle valve tips can be found in U.S. Pat. No. 3,836,080 to Butterfield et al. U.S. Pat. No. 4,213,568 to Hoffman, and U.S. Pat. No. 4,523,719 also to Hoffman. Of these, the Butterfield et al. closed nozzle injector is further specifically designed to reduce the SAC volume under the nozzle valve tip. The design of Butterfield et al. is directed to solve the same problem of the Gardner et al. patent. Likewise, the problem attempted to be solved by Butterfield is not analogous to that within an open nozzle type injector wherein specific metering requirements must be met as well as reducing trapped volume and causing injection.

Thus, there is a need for an open nozzle unit fuel injector that can reduce trapped volume between the minor diameter of the plunger and the inner wall of the injector cup while still permitting sufficient fuel flow therebetween to accurately and effectively control the fuel quantity and reduce unburned hydrocarbons in the emissions. Moreover, there is a need to provide such an open nozzle unit fuel injector that will function accurately over the entire useful life of such an injector without adversely affecting fuel metering even after the plunger and cup surfaces become fully carboned.

SUMMARY OF THE INVENTION

It is an object of the present invention to provide an open nozzle unit fuel injector that overcomes the deficiencies described above in the prior art open nozzle unit fuel injectors.

It is a further object to provide an open nozzle unit injector that has the capability to reduce the trapped volume between the plunger and the cup in the labyrinth flow area without adversely affecting the metered flow of fuel to the cup. Preferably, when the plunger is seated in the cup after injection the trapped volume between the plunger and the cup is much less than the conventional prior art trapped volume for the same flow area through the labyrinth seal area.

It is another object of the present invention to lessen the influence of injector carboning on the quantity o metered flow through the labyrinth flow area. Whereas the carboning of the plunger and cup in an open nozzle injector is a function of the cylinder gas blowing back within the injector at the end of fuel injection, carbon builds up on the injector components to restrict the flow of fuel, specifically in the labyrinth flow area. Moreover, it is desirable to lessen the effect of carboning while also reducing the trapped volume in the labyrinth flow area.

It is yet another object of the present invention to provide a modified plunger and cup design that will allow effective fuel metering even after the plunger and cup become fully carboned. The effect of carboning will reach an upper limit once the plunger minor diameter section and the cup inner wall become fully carboned, wherein the modified design permits sufficient fuel flow during metering with a minimum of flow loss at the upper limit of carboning. As a matter of fact, it is an object of the present invention to actually encourage the injector carboning because the upper limit of total carboning only minimally effects metered fuel flow through the labyrinth flow area, and once the injector is fully carboned, the injector will operate consistently without further reduction of fuel flow loss.

It is yet another object of the present invention to provide an open nozzle unit fuel injector including a plunger with a major diameter section and a minor diameter section, wherein the minor diameter section extends at least partially within the bore of the injector cup throughout the plunger stroke, and the gap between the minor diameter section and the inner surface of the cup bore is modified so that in a fully advanced position of the plunger, the gap at the lower most edge of the minor diameter section is smaller than the gap at the lower most edge of the minor diameter section when the plunger is in the fully retracted position. Thereby, the plunger and the cup advantageously define a reduced trapped volume in the advanced position as compared to prior art open nozzle unit injectors, while providing a sufficiently large flow area at the labyrinth flow area in the retracted position so as not to restrict the flow of fuel through the labyrinth flow area during metering. The capability to reduce the trapped volume advantageously reduces unburned hydrocarbon emissions while permitting accurate and effective fuel metering. Additionally, such a modified cup and plunger design allows effective metering of fuel through the labyrinth flow area with only a minimal effect of injector carboning, whether or not the trapped volume is reduced. The modified design advantageously limits the total amount of carbon that can build up in this region and assists in preventing the cylinder gases from blowing back further into the injector.

It is yet another object of the present invention to provide an open nozzle unit fuel injector with a modified radial gap between the minor diameter section of the plunger and injector cup by providing, in one embodiment, both the outer surface of the minor diameter section of the plunger and the inner surface of the axial bore of the injector cup with stepped portions of constant diameter, wherein the stepped diameter portions are reduced in diameter toward the injection orifices at the nozzle.

It is still another object of the present invention to modify the radial gap, in a second embodiment, by forming both the outer surface of the minor diameter section of the plunger and the inner surface of the axial bore of the injector cup as tapered surfaces, wherein the tapered surfaces are made to decrease the diameter of the minor diameter section of the plunger and the axial bore of the cup toward the injection orifices at the nozzle.

It is yet another object of the present invention to modify the radial gap, in a third embodiment, to provide a stepped surface on the inner wall of the axial bore of the injector cup while maintaining a substantially constant minor diameter section of the plunger. In this embodiment, the inner wall of the cup is stepped to reduce the diameter of the bore toward the injection orifices, and the lowermost stepped portion significantly reduces the gap between itself and the minor diameter section of the plunger for effectively reducing the trapped volume.

These and other objects of the present invention are achieved by an open nozzle unit fuel injector including an injector body comprising a barrel and a cup positioned end to end with an axial bore extending through the barrel and into the cup with an injection orifice extending through the end of the cup for injecting fuel from the axial bore into a cylinder of an internal combustion engine. Disposed within the axial bore is a plunger that is reciprocably movable and synchronously driven by an operating system from a crankshaft of the internal combustion engine to move between a retracted position and an advanced position. The plunger includes a major diameter section slidably engaged within the axial bore and a minor diameter section that extends within a reduced axial bore of the cup at least partially throughout the stroke of the plunger between the retracted and advanced positions. A radial gap is formed between the minor diameter section of the plunger and the axial bore of the cup, and the radial gap is modified so that in the advanced position of the plunger the radial gap between the lowermost edge of the minor diameter section and the inner wall of the cup is smaller than the radial gap between the lowermost edge of the minor diameter section and the inner wall of the cup when the plunger is in the retracted position.

In one embodiment, the gap is modified by providing stepped diameter portions along the minor diameter section of the plunger and along the inner wall of the cup with the diameters of the stepped portions being substantially constant in each portion with the diameters decreasing in size toward the injection orifice. In a second embodiment, the inner wall of the cup as well as the minor diameter section of the plunger are tapered to decrease in diameter toward the injection orifice. In a third embodiment, only the inner wall of the cup is stepped to reduce the diameter toward the injection orifice while the minor diameter section is maintained constant throughout.

The result is that the trapped volume formed between the minor diameter section of the plunger and the inner wall of the cup can be significantly reduced in the advanced position of the plunger corresponding to the end of injection, while in the retracted position corresponding to the metering stage of injector operation the flow area through the labyrinth flow area is not restricted. Moreover, the flow area through the labyrinth flow area during metering remains predominantly unaffected by carboning.

These and further objects, features and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
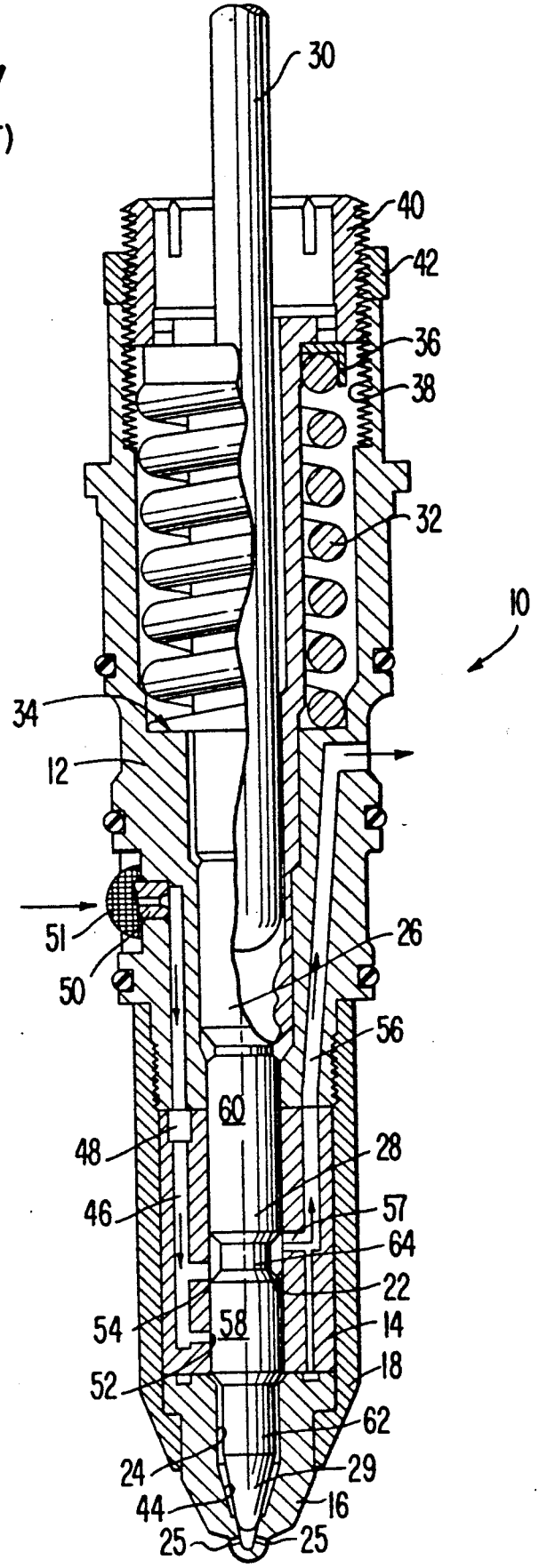
FIG. 1 (PRIOR ART)
FIG. 1 is a vertical, cross-sectional view with parts broken away, of an open nozzle unit fuel injector as conventionally known.

Referring now to the drawings and in particular to FIG. 1, an open nozzle unit fuel injector 10 is shown that is representative of a prior art fuel injector to which the present invention is applied. Moreover, the specific construction and operation of the fuel injector 10 are disclosed in U.S. Pat. No. 4,280,659 to Gaal et al. and U.S. Pat. No. 4,601,086 to Gerlach, both commonly owned by the assignee of the present application, and both incorporated herein by reference.

The open nozzle injector 10 includes an injector body 12, a barrel 14, and a cup 16 positioned in end-to-end relationship. A threaded retainer 18 extends around the barrel 14 and secures the cup 16 and barrel 14 to the injector body 12. An axial bore 20 is provided through the injector body 12, the barrel 14 and most of the way through cup 16. The axial bore 20 is divided into a first portion 22 that comprises the part of the axial bore 20 extending through the injector body 12 and the barrel 14, and a second portion 24 that extends into the cup 16. The second portion 24 is of a smaller diameter than the first portion 22. Note the first portion 22 also includes varying diameter sections; however, only the diameter of the lower portion is critically sized for reasons which will be apparent below as related to the present invention.

A plunger assembly 26 is reciprocably disposed within the axial bore 20 and includes a lower plunger 28. The plunger assembly 26 is reciprocably driven by a rod 30 that is operatively driven by an injector drive train (not shown). The injector drive train preferably interconnects the unit injector 10 to an engine camshaft to synchronously drive each unit injector of each cylinder of the internal combustion engine, wherein the injector camshaft is operatively driven and timed to the engine crankshaft. It is of course understood that a unit injector is provided for each cylinder of the internal combustion engine and each unit injector includes a drive train for translating recriprocably movement to the plunger assembly 26.

A return spring 32 is mounted in an enlarged area of axial bore 20, and the lower end of return spring 32 is positioned on a ledge 34. The upper end of spring 32 engages a washer 36 that is axially fixed in the upward direction to the plunger assembly 26. The return spring 32 therefore urges the plunger assembly 26 upwardly including the lower plunger 28. The upper end of the injector body 12 is internally threaded as indicated at 38 and a top stop 40 is threaded to the injector body 12. A lock nut 42 secures the top stop 40 at a selected position, so as to form a stop which limits the upward movement of washer 36 and thus the plunger assembly 26. The plunger assembly 26 is limited in its downward stroke by the engagement of the tip 29 of the lower plunger 28 against a seat 44 of the cup 16.

A fuel supply passage 46 is provided that passes through the injector body 12 and barrel 14 and includes a check valve 48 which permits the flow of fuel in only the supply direction indicated by the arrows. The upper end of the fuel supply passage 46 connects with an inlet regulating plug 50 covered by a screen 51 to prevent impurities from entering the injector. It is understood that the inlet 50 is associated with a common fuel supply rail (not shown) that is conventionally provided within the engine head (also not shown) for supplying fuel to each of the unit injectors 10 of the internal combustion engine.

The fuel supply passage 46 further includes a supply orifice 52 that opens into the first portion 22 of the axial bore 20. The supply orifice 52 permits fuel to flow to a metering chamber that is defined below the lower plunger 28 and within the axial bore 20 as further described below. At the end of second bore portion 24 are injection orifices 25 through which metered fuel is injected into an engine cylinder. A second supply orifice 54 also opens to the first portion 22 of the axial bore 20 at a point above the supply orifice 52. The second supply orifice 54 supplies fuel for scavenging as described hereinafter.

A drain passage 56 is also provided through barrel 14 and the injector body 12 interconnecting the axial bore 20 to a drain line (not shown) of the internal combustion engine.

The lower plunger 28 is divided into a first major diameter section 58, a second major diameter section 60, and a minor diameter section 62. The first and second major diameter sections 58 and 60 are separated by a scavenging groove 64 that connects the second supply orifice 54 to the drain passage 56 at drain port 57. The scavenging groove 64 allows fuel to flow through the scavenging groove 64 when the lower plunger 28 is in an advanced position as in FIG. 1 for cooling and lubricating the lower plunger 28 as well as for removing any gases that may accumulate therein from backflow of gas into the injector from the engine cylinder.

The minor diameter section 62 extends within the bore 24 of the cup 16, and the bore 24 is of a diameter larger than the minor diameter section 62.

Figure 3:
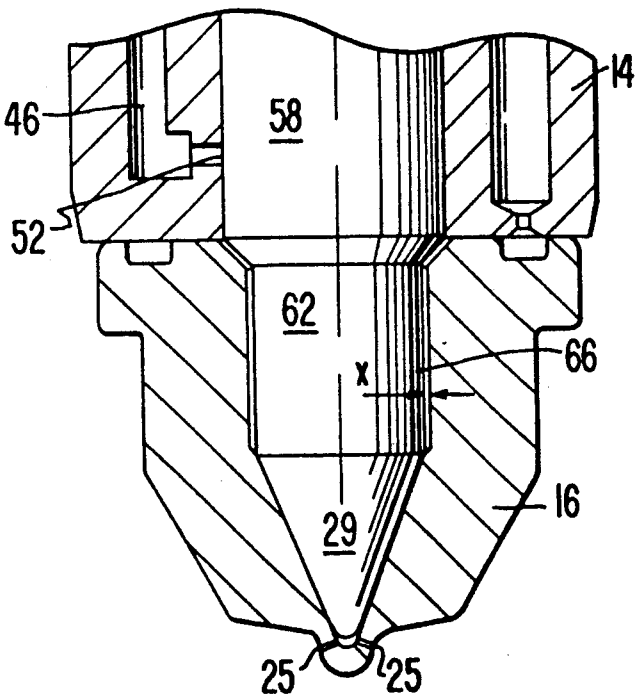
FIG. 3 (PRIOR ART)
FIG. 3 is a similar enlarged, fragmentary view of the lower end of the injector as in FIG. 2 with the plunger in a fully advanced position corresponding to just after injection in the injector operating cycle.
Figure 2:
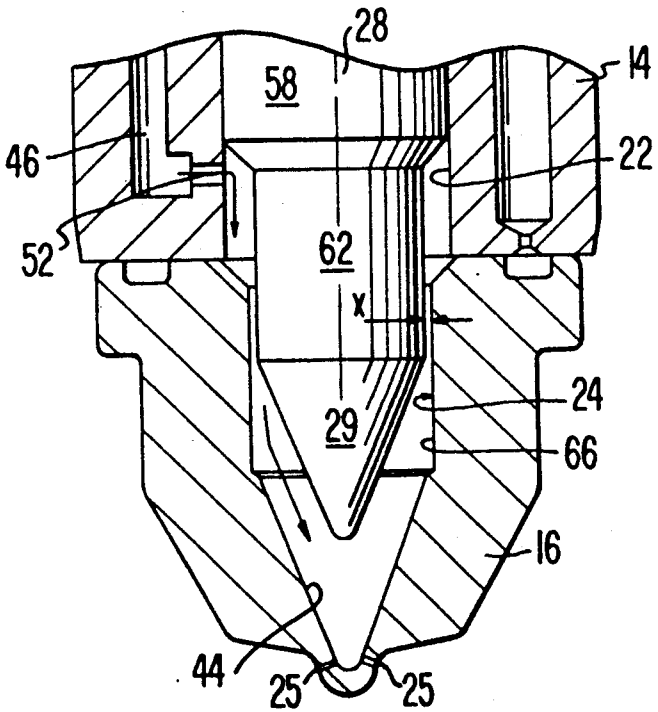
FIG. 2 (PRIOR ART)
FIG. 2 is an enlarged fragmentary view of the lower end of the injector shown in FIG. 1 with the plunger in a retracted position corresponding to the metering stage of the injector cycle.

Referring now to FIGS. 2 and 3, the operation of such a unit fuel injector 10 will be described. In FIG. 2, the injector 10 is shown in the metering stage wherein the lower plunger 28 is in its fully retracted position. In the metering stage, pressurized fuel is supplied through supply orifice 52 in accordance with pressure and time principles, while the major diameter section 58 is located above the supply orifice 52 so as not to impede the flow of fuel into the lower end of axial bore 20. Thus, it can be seen that the pressure of fuel supplied through orifice 52 and the time that the major diameter portion 58 is above the supply orifice 52 determines the amount of fuel that will be metered into the axial bore 20. It can also be seen in FIG. 2 that the minor diameter section 62 and the inner wall 66 of the bore 24 within cup 16 defines a radial gap x through which fuel passes toward the open injection orifices 25 as indicated by the arrows. Note that the minor diameter section 62 always extends at least partially within the second portion 24 of axial bore 20 even in the retracted-most position of lower plunger 28. The region along the minor diameter section 62 and the inner wall 66 of cup 16 is referred to as the labyrinth flow area.

After metering, the lower plunger 28 is driven inwardly by the rod 30 from the drive train (not shown) to strike the fuel metered within the lower portion of bore 24 of cup 16 and to inject the metered quantity of fuel through injection orifices 25 and into a cylinder of an internal combustion engine. As can be seen in FIG. 3, the plunger 28 is shown in the fully advanced position reflecting its position just after injection is completed at which time the tip 29 of the lower plunger 28 is seated on seat 44 of the cup 16.

As is also shown, the radial gap x is defined as substantially constant along the entire length of the minor diameter section 62 within the bore 24 of the cup 16. This radial gap x forms a volume along the extent that the minor diameter section 62 extends within the cup 16 which is maintained with fuel that has not been injected. This fuel is defined as the trapped volume of fuel that is maintained within the cup 16 after injection and which has been found to migrate into the engine cylinder after combustion so as to increase the presence of unburned hydrocarbons in the vehicle emissions.

Thus, as amplified above in the Background section of the application, it is a specific purpose of the present invention to reduce this trapped volume and thus reduce the presence of unburned hydrocarbons in vehicle emissions. However, and as also pointed out in the Background section, it is impossible to reduce the trapped volume by simply closing the gap between the minor diameter section 62 and the inner wall 66 of the cup 16 because, as illustrated in FIG. 2, the metered quantity of fuel from supply orifice 52 must be able to adequately pass between the minor diameter section 62 and the inner wall 66 of cup 16, that is the labyrinth flow area. Moreover, the size of the radial gap x must be sufficient that the flow through the labyrinth area is sufficient that a desired metered quantity of fuel can be provided.

Furthermore, as the unit injector is used over a period of time, the outer surface of the minor diameter section 62 and the inner wall 66 of cup 16, as well as all of the plunger and cup minor diameter surfaces, will become coated with carbon that builds up from the blow back of hot gases within the injector from the cylinder of the internal combustion engine. More specifically, the carbon forms on the plunger and cup surfaces as a result of essentially oil, fuel and the temperature in the unit injector metering chamber. Such carboning is most likely to occur during engine operating conditions wherein there is little or no fuel present in the metering chamber. An example of such a condition is known as a motoring condition where the engine is driven from the vehicle drive train and little or no fuel is supplied to the metering chamber. Thus, when the plunger tip unseats from the cup, airborne carbon enters the metering chamber from the engine combustion chamber through the injector spray holes, and then deposits on the surfaces of the plunger and cup. This is facilitated by the fact that any fuel left within the metering chamber a subjected to the higher temperatures has a tendency to form a layer of an adhesive substance on the plunger and cup surfaces to which the black carbon flakes adhere. Obviously, the greater the extent that the carbon builds up on the plunger and cup surfaces, the greater the effect of the carboning on the labyrinth fuel flow area through which the metered fuel must pass. Moreover, as this labyrinth flow area becomes restricted, the quantity of metered fuel flow through the labyrinth flow area based on pressure and time principles is limited to a point at which adequate fuel metering becomes impossible. This sensitivity of open nozzle fuel injectors to carboning is responsible for a major portion of service required on such open nozzle injectors, wherein service is needed after each period of usage during which excessive carboning occurs.

As a result, the radial gap x will be reduced by the carboning of the injector elements and thus the metering of fuel through the labyrinth flow area will also be affected by the carboning thereof. The smaller the manufactured radial gap, the greater the sensitivity to and effect of carboning.

Thus, it is a specific purpose of the present invention to reduce the trapped volume of fuel at the end of injection while also permitting sufficient metered fuel flow through the labyrinth fuel area with a reduced sensitivity. Moreover, the present invention ensures for sufficient fuel flow through the labyrinth fuel area even after the plunger and cup become fully carboned.

Referring now to FIGS. 4–8, a first embodiment of the present invention is illustrated which is designed to achieve the above-mentioned specific goals. A partial cross-sectional view of an open nozzle unit injector 100 is shown having a lower plunger 128 reciprocably movable therein and driven by an associated injector drive train (not shown). The lower plunger 128 includes a major diameter section 158 that is slidably engaged within a first portion 122 of an axial bore 120 that passes through the barrel 114. The lower plunger 128 further includes a minor diameter section 162 that extends within a second portion 124 of the axial bore 120 that is defined within the cup 116. A fuel supply passage 146 is also shown within the barrel 114 and includes a supply orifice 152 for allowing fuel flow within the lower end of bore 122 and into the metering chamber of bore 124.

Figure 4:
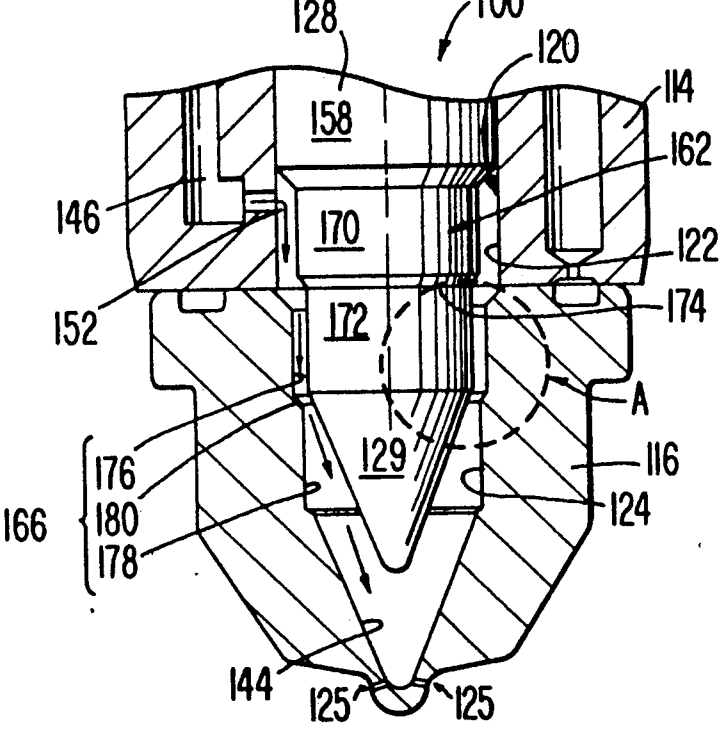
FIG. 4 is a partial cross-sectional view of a first embodiment designed in accordance with the present invention illustrating a stepped minor diameter section of a plunger and a correspondly stepped inner wall of the injector cup with the injector in its retracted position corresponding to the metering stage.

FIG. 4 shows the position of the injector 100 in the metering stage with the lower plunger 128 in a fully retracted position, that is permitting fuel flow from the supply orifice 152 to the metering chamber. The direction of fuel flow is indicated by the arrows in FIG. 4. To facilitate the flow of fuel through the labyrinth flow area, between the outer surface of the minor diameter section 162 of the lower plunger 128 and the inner wall 166 of the cup 116, the minor diameter section 162 and the inner wall 166 are stepped. More specifically, the minor diameter section 162 includes a first substantially constant diameter portion 170 and a second constant diameter portion 172 that are interconnected by an annular step 174. Extending from the lower end of the second constant diameter portion 172 is the conical plunger tip 129 that is used to force the metered fuel through injection orifices 125 during injection. Furthermore, the inner wall 166 is divided into a first portion 176 and a second portion 178 that are connected by an annular step 180 in a similar constant diameter manner as the stepped portions 170 and 172 of the lower plunger 128. Moreover, the present invention allows the diameter of the first portion 176 of the inner wall 166 of cup 116 to be made just slightly larger than the first portion 170 of the lower plunger 128 without adversely affecting metering. Likewise, the second portion 178 of the inner wall 166 is preferably dimensioned just slightly larger than the diameter of the second portion 172 of the lower plunger 128.

Figure 5:
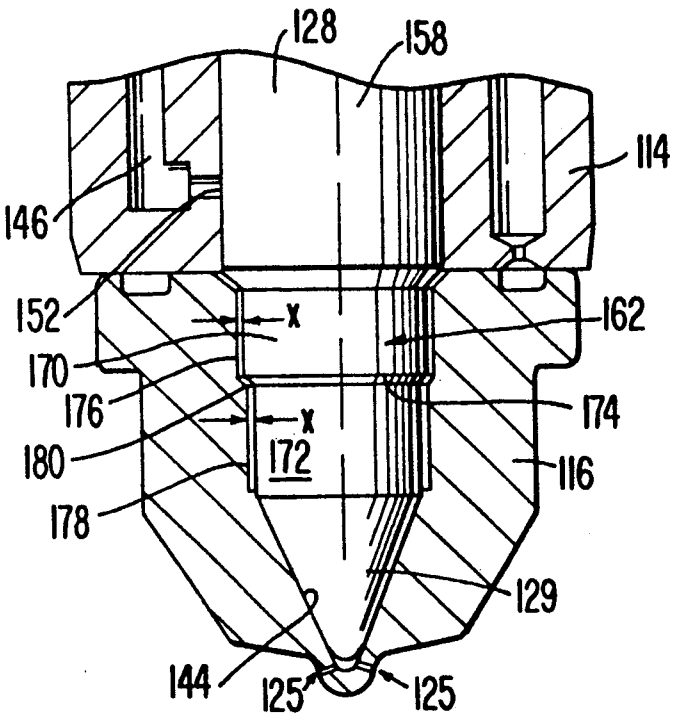
FIG. 5 is a view similar to FIG. 4, except with the plunger in the fully advanced position just after injection.

It is a specific purpose of the present invention to design the stepped plunger and cup so that the radial gap x formed between the minor diameter section 162 of the lower plunger 128 and the inner wall 166 of cup 116 can be minimized when the lower plunger 128 is in a fully advanced position as shown in FIG. 5. More specifically, the radial gap x is made to be much smaller than the radial gap permitted in the prior art injectors such in FIGS. 1–3.

In FIG. 5, the first portion 170 and the second portion 172 of the minor diameter section 162 of the lower plunger 128 are disposed within the first portion 176 and the second portion 178 of the inner wall 166 of the cup 116, respectively. The radial gap x between both the first portions 170 and 176 of the plunger and cup, respectively, and the second portions 172 and 178 of the plunger and cup, respectively, are equal. It is not necessary that they be equal, but it is preferable that they be minimized and equal. Although the radial gap x is made to be much smaller than in the prior art, the stepped plunger and cup injector shown in FIGS. 4 and 5 does not suffer the deficiencies related to metering sensitively as noted with respect to the prior art and discussed above. This is because the axial lengths of the stepped portions are designed such that when the lower plunger 128 is moved upwardly to its fully retracted position, the lower plunger 128 moves an axial distance at least just greater than the length of the lowermost stepped portion shown by portion 172 of the plunger and portion 178 of the inner wall 166 in FIG. 4. As a result, the lowermost plunger portion 172 lies within the next higher inner wall portion 176 that has a sufficiently greater diameter than the lowermost inner wall portion 178 defined by step 180. As can be seen in FIG. 4, such displacement allows the metering of fuel flow without reduced sensitivity or regard to the specifically minimized radial gap between the plunger and cup when seated as shown in FIG. 5.

Moreover, it has been found that even when the outer surface of the minor diameter section 162 and the inner wall 166 of cup 116 become fully carboned during usage of the injector, the extent of carboning is upwardly limited by the radial gap x thus minimizing the total carboning potential. Furthermore, a minimum flow area through the labyrinth flow area is guaranteed. Thus, even when the surfaces of the minor diameter section 162 and the inner wall 166 become fully carboned, the annular steps, such as at 174 and 180, are great enough to allow adequate fuel metering through the labyrinth flow area when the lower plunger 128 is fully retracted. This is because the annular steps 174 and 180 of the plunger and cup, respectively, define a radial step differential sufficient to guarantee adequate flow even with full carboning. With this in mind, it is further beneficial to actually encourage the formation of carboning, since after the cup and plunger are fully carboned, the open nozzle unit injector will operate very consistently with a guaranteed labyrinth flow area.

Figure 6:
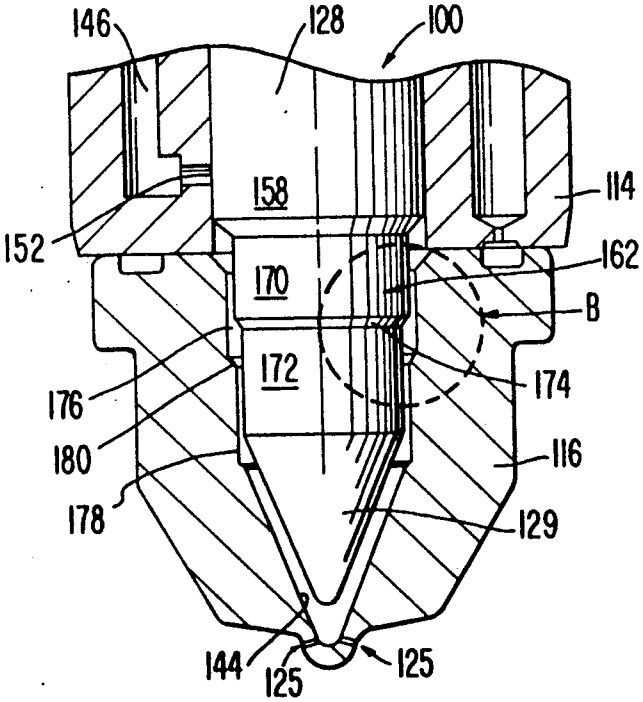
FIG. 6 is a view similar to FIGS. 4 and 5 showing the plunger in an intermediate stage with the plunger partially retracted from engagement with the injector cup.

With reference now to FIG. 6, a view similar to FIGS. 4 and 5 is shown except that the lower plunger 128 is in an intermediate position between that shown in FIGS. 4 and 5. This intermediate position corresponds to either a position just subsequent to that in FIG. 5 wherein the lower plunger 128 is in the process of being retracted away from the cup 116 which occurs just prior to the start of metering, or to the position just after metering has been completed and injection of fuel within the metering chamber is occurring. In either case, it can be seen how the annular step 174 on the lower plunger 128 between plunger portions 170 and 172 is offset from the annular step 180 between inner wall surfaces 176 and 178 of the cup 116. Moreover, the plunger surface portion 170 is still in a position partially adjacent the upper inner wall portion 176, and the lowermost plunger portion 172 is still partially adjacent the inner wall portion 178.

In the preferred embodiment of the stepped plunger and cup design of the present invention, the radial gap or clearance between the minor diameter portions of the plunger and the inner wall of the cup is preferably maintained within the range of between 0.001 and 0.004 inches, and the metering clearance is between 0.006 and 0.008 inches. However, it is understood that the clearance can be adjusted according to each specific situation or application, depending on operating conditions and the like.

Figure 7:
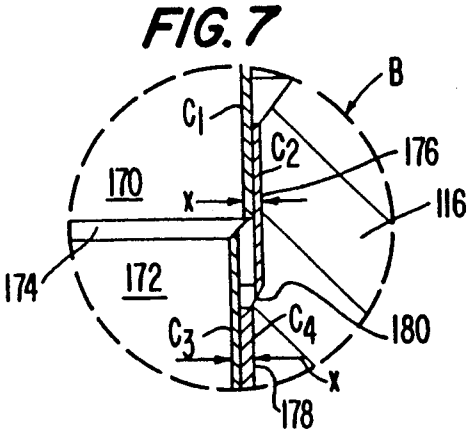
FIG. 7 is an enlarged cross-section of the area within circle B identified in FIG. 6 showing carbon build-up on the injector plunger and cup surfaces.
Figure 8:
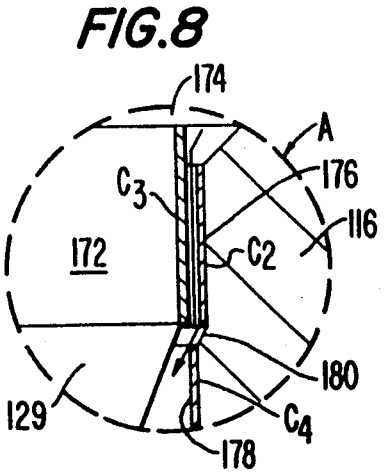
FIG. 8 is an enlarged cross-section of the area within circle A identified in FIG. 4 illustrating an adequate fuel flow path even after the injector plunger and cup surfaces are fully carboned.

As seen in FIGS. 7 and 8, the lower plunger minor diameter portions 170 and 172 and cup inner wall surfaces 176 and 178 are illustrated with a carboning layer thereon to the point that the surfaces are considered fully carboned. Specifically, the uppermost minor diameter portion 170 is shown coated with a carbon layer $C_1$ (in cross-section), the lowermost minor diameter plunger section 172 is shown coated by a carbon layer $C_3$, the uppermost cup inner wall portion is coated with a carbon layer $C_2$, and the lowermost cup inner wall portion 178 is coated with a carbon layer $C_4$. The total thickness of these carbon layers is advantageously limited by the size of the radial gap x. As the lower plunger 128 moves axially relative to the cup 116, the carbon layers $C_1$ and $C_2$ and $C_3$ and $C_4$, are are slid with respect to one another leaving therebetween only a minimal flow path in this intermediate position through the labyrinth flow area. The thickness of the layers illustrated in FIGS. 7 and 8 are exaggerated for the purposes of illustration, but accurately depict the effect of carboning on the labyrinth flow area and the sensitivity of metering to the affects of carboning.

While the lower plunger 128 is in the process of being retracted for fuel metering, and as described above with regard to FIG. 6, the minor diameter plunger portions 170 and 172 lie partially adjacent the cup inner surface portions 176 and 178, respectively, with the carbon layers $C_1$, $C_2$, and $C_3$, $C_4$, in contact with one another. Then, as the lower plunger 128 is fully retracted, and metering begins, the lowermost minor diameter plunger portion 172 has also been moved to a position above the annular step 180 of the cup inner wall and has assumed a position adjacent to but spaced from the next upper cup inner wall portion 176. Moreover, the carbon layer $C_3$ has assumed a position adjacent the carbon layer $C_2$ which is offset radially away from the carbon layer $C_3$ by an amount defined by the annular step 180. This amount of step differential represented by annular step 180 ensures the adequate flow area through the labyrinth flow area even after the plunger and cup surfaces are fully carboned. Thus, an adequate minimal flow area through the labyrinth flow area is guaranteed.

Furthermore, the stepped plunger and cup design has been found to reduce the effect of carboning on the major diameter section 158 of the lower plunger 128 by reducing the backflow of hot combustion gases that are blown back through the injection orifices 125 from the engine cylinder, by providing barriers along the flow path. These barriers are made by the steps along the radial gap x and by the reduction of the radial gap x itself. The result is that less of the hot combustion gases can migrate upwardly to affect the major diameter section 158 and other elements of the open nozzle injector thereabove.

Figure 9:
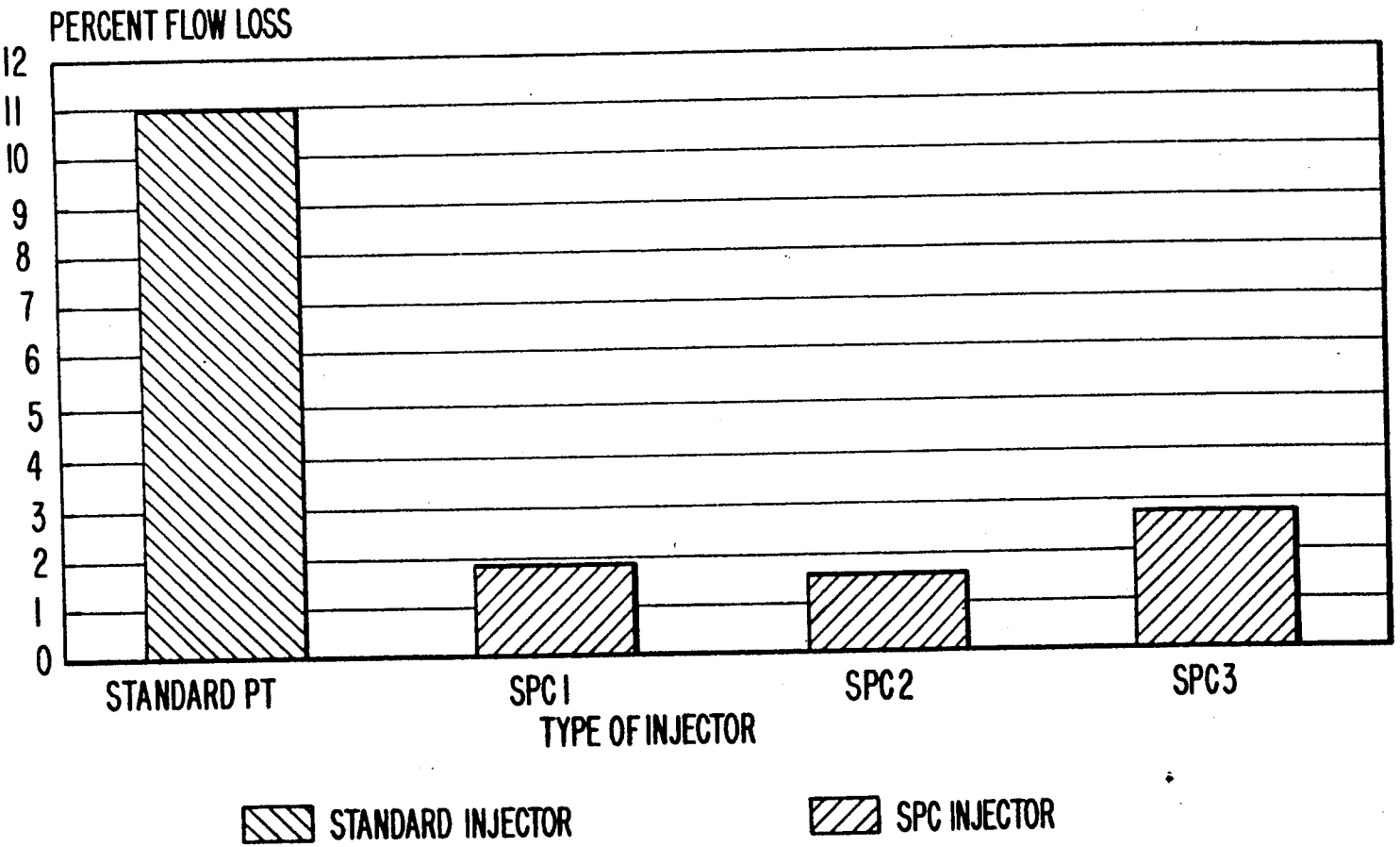
FIG. 9 is a bar graph comparing a standard pressure-time injector with an injector formed in accordance with the present invention and as shown in FIGS. 4 and 5 illustrating average injector flow loss due to carboning of the injector.

Referring now to the bar graph shown in FIG. 9, a standard pressure-time (PT) injector is compared to the stepped plunger and cup (SPC) design of the present invention. Specifically, the graph shows the average injector flow loss through the labyrinth seal area as the injector is subject to carboning. The standard PT injector suffers a percentage flow loss as high as 11 percent from cyclic carboning of the injector plunger and cup, while the stepped plunger and cup design, tested at three different radial gaps, showed a maximum of less than 3 percent flow loss caused by the cyclic carboning. The results clearly support the above assertion that the effect of carboning on the stepped plunger is greatly reduced by the stepped plunger and cup design, and even as the plunger and cup become fully carboned there is only a minimal effect on the flow. This is because of the fact that the plunger is axially moved by a distance just greater than the axial length of at least the lower most stepped portions in the fully retracted position.

Figure 10:
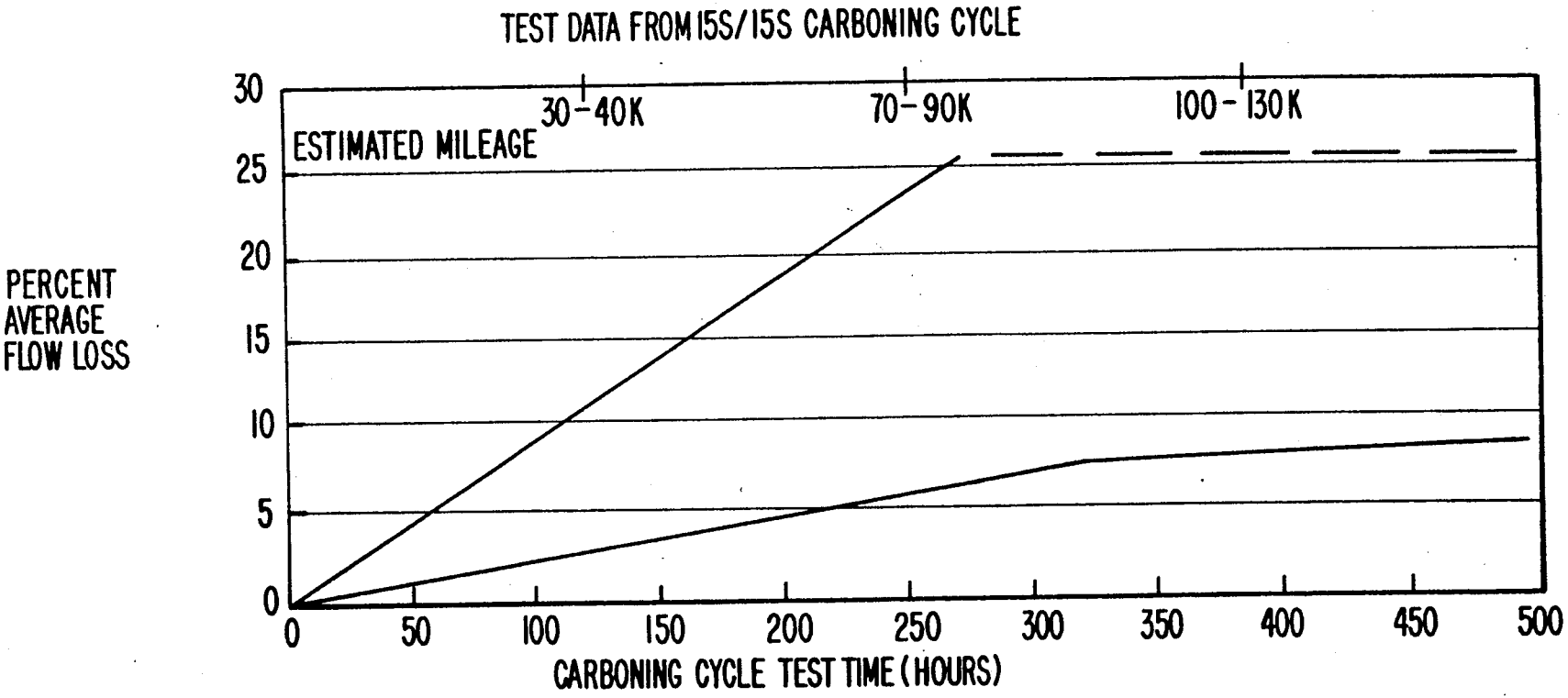
FIG. 10 is a graphical illustration comparing percent average flow loss to the test time for a carboning test cycle and comparing a standard PT injector to a stepped plunger and cup design of the present invention over an estimated mileage period.

The graph illustrated in FIG. 10 compares the percent average flow loss for a standard PT unit injector, that is, having a plunger and cup design as in FIGS. 1–3, to a unit injector having a stepped plunger and cup design as illustrated in FIGS. 4–8 and in accordance with the present invention. The percent average flow loss is determined over a test time for a carboning cycle test noted as a 15-second/15-second carboning cycle. This test was conducted by subjecting an engine provided with such injectors for consecutive periods of 15 seconds motoring, then 15 seconds power mode at approximately 60 horsepower. This consecutive cycle was conducted for the time periods noted along the lower horizontal axis of the graph in hours. Such tests were conducted on both the standard PT unit injector and the stepped plunger and cup designed unit injector of the present invention with the upper graphed line in FIG. 10 showing the results for the standard PT unit injector and the lower graphed line indicating the results for the stepped plunger and cup design. Moreover, the extent of carboning for the standard PT unit injector was compared to known actual values based on mileage and use to provide an estimated mileage of injector use, as noted on the upper horizontal graph axis.

As is readily apparent, the tests showed percent average flow losses of two to three times more for the standard PT unit injector than the flow losses associated with the stepped plunger and cup design of the present invention. Typically, the stepped plunger and cup design resulted in percent average flow losses no higher than 8–9 percent. In contrast, the non-stepped standard PT unit injector obtained flow losses as high as 20–30 percent. Additionally, it was observed that the cylinder-to-cylinder flow loss variability for the stepped plunger and cup injector was much lower than the variability typically seen on the standard PT unit injectors. This is because the stepped plunger and cup design sets the upper limit for a fully carboned injector which guarantees the adequate fuel metering at a minimum of flow loss.

Figure 12:
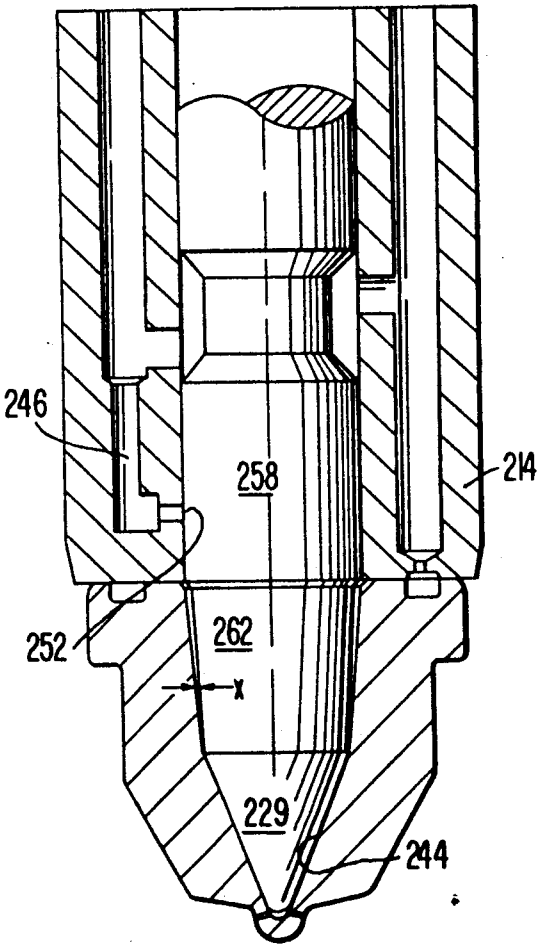
FIG. 12 is a view similar to FIG. 7 with the plunger fully advanced to its position just after injection.
Figure 11:
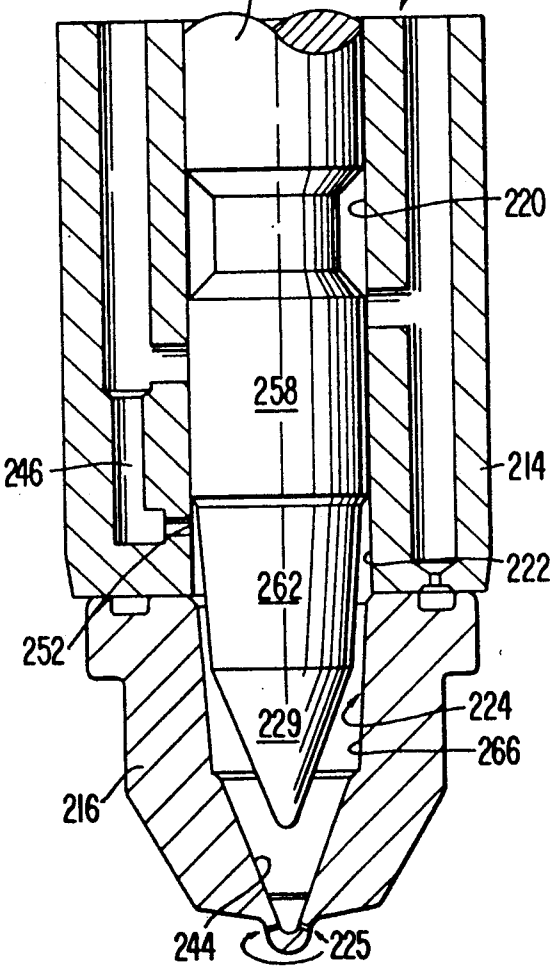
FIG. 11 is a partial cross-sectional view of a second embodiment of an open nozzle unit fuel injector formed in accordance with the present invention showing a tapered plunger minor diameter section and inner wall of the cup with the plunger in its retracted position corresponding to the metering stage.

With reference now to FIGS. 11 and 12, a second embodiment of a modified plunger and cup for an open nozzle fuel injector designed in accordance with the present invention is illustrated and described below. In this case, instead of including a stepped plunger and cup as in the above embodiment, the plunger and cup are tapered to reduce the diameters thereof in the direction towards the injection orifices 225. More specifically, a plunger 228 includes a major diameter portion 258 slidably engaged within a first bore portion 222 and a minor diameter section 262 extended within a second axial bore portion 224 provided within the cup 216.

The minor diameter section 262 of the lower plunger 228 is designed to have a decreasing diameter from the point at which the minor diameter section 262 adjoins the major diameter section 258 to the lowermost point of the minor diameter section from which begins the conical tip 229 of the lower plunger 228. Likewise, the inner wall 266 of the cup 216, defined by the second bore portion 224, is similarly tapered so as to decrease the diameter of the bore 224 in the direction from the edge of the cup 216 that abuts the barrel 214 to the end of the cup 216 with the injection orifices 225. The tapered inner wall 266 does not affect the normal conical shape of the seat portion 244.

As can be seen in FIG. 11, fuel is metered from supply passage 246 through supply orifice 252 and into the lower end of bore first portion 222 and into the cup bore 224. The labyrinth flow area defined between the minor diameter section 262 and the inner wall 266 of the cup 216 permits sufficient fuel flow for fuel metering in accordance with pressure-time principles as enumerated above. Moreover, as shown in FIG. 12, the trapped volume defined by the radial gap x which is substantially constant along the entire length of the minor diameter section 262 can be minimized. As in the first embodiment, the radial gap x is made to be much less than that of conventional straight plunger and cup designs. Then, when the plunger is retracted, the slope of the tapered minor diameter section 262 and inner wall 266 of the cup 216 provide for adequate fuel metering through the labyrinth fuel area.

Also and as above, the effect of carboning is greatly reduced because even if the carboning upper limit defined by the radial gap x becomes fully carboned, when the lower plunger 228 is fully retracted a sufficient fuel metering gap can be defined by appropriate design of the slope of the tapered surfaces. Additionally, the tapered surfaces and the minimized radial gap x further effectively limit the blow back of combustion gases within the unit injector so as to reduce the effect of carboning on the major diameter section 258 and other injector elements thereabove.

Figure 14:
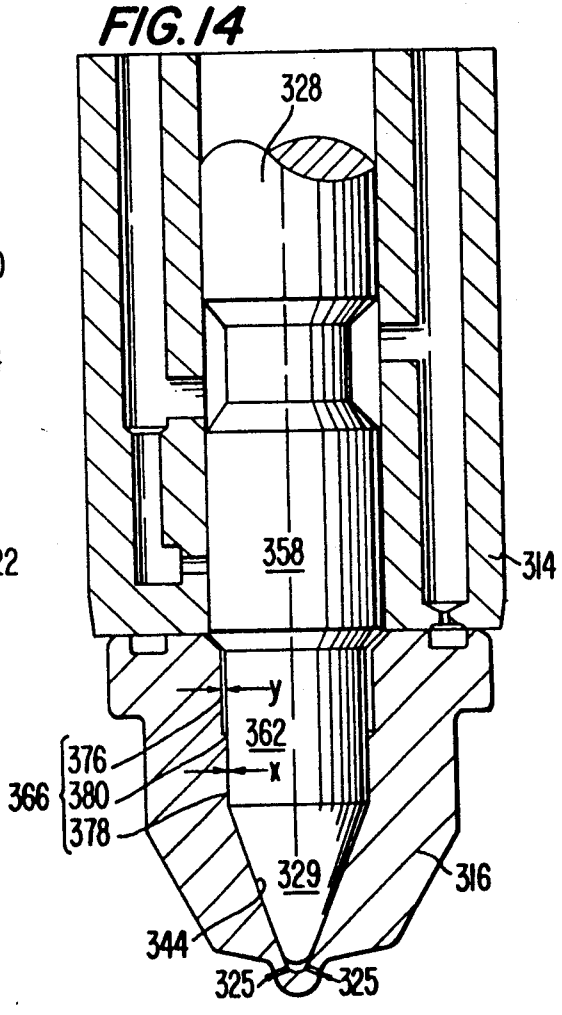
FIG. 14 is a view similar to FIG. 9 with the plunger in its fully advanced position just after injection.
Figure 13:
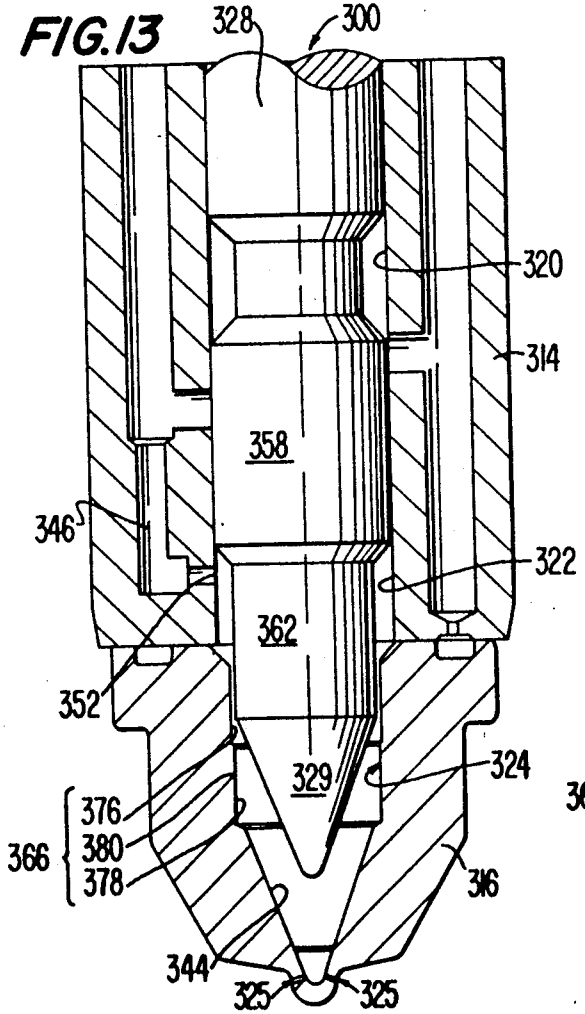
FIG. 13 is a partial cross-sectional view of a third embodiment of an open nozzle unit fuel injector formed in accordance with the present invention wherein the inner wall of the cup is stepped while the plunger minor diameter section is constant, with the plunger in its retracted position corresponding to the metering stage.

A third embodiment of an open nozzle unit injector 300 designed in accordance with the present invention is illustrated in FIGS. 13 and 14. The injector 300 includes a lower plunger 328 with a major diameter section 358 that is slidably engaged with a first bore portion 322 and a minor diameter section 362 that extends within a second bore portion 324 provided in the cup 316. As can be seen in FIGS. 9 and 10, the minor diameter section 362 is of a constant diameter throughout its entire length. However, the inner wall 366 of the cup 316 is provided with stepped portions 376 and 378 with step 380 therebetween. These stepped portions, 376 and 378, are similarly designed as the first and second stepped portions 176 and 178 of the embodiment shown in FIGS. 4–8.

As shown in FIG. 14, this embodiment loses some of the effect of the stepped plunger and cup design of FIGS. 4 and 5 in that only the lowermost step provided by portion 378 of the inner wall 366 is designed to minimize the radial gap x thereat, while a second radial gap y is defined between the minor diameter section 362 and the first portion 376 of the inner wall 366 of cup 316. The radial gap y is greater than the radial gap x. However, because the radial gap x is minimized, there is still a substantial reduction of the trapped volume While providing an injector with reduced sensitivity to metering and carboning. Specifically, the upper limit of carboning is set between plunger portion 362 and cup inner wall portion 378.

Also advantageously, such a design allows an injector to be manufactured with only the cup 216 modified. This embodiment permits the manufacture of an improved open nozzle injector with a substantially reduced cost since no additional machining is necessary for the lower plunger 328, but which effectively at least reduces a substantial portion of the trapped volume. Moreover, this embodiment permits the retrofitting of open nozzle injectors already in existence with a stepped cup with the non-stepped plunger assembly of the retrofitted injector.

The principles of operation of the stepped cup and non-stepped plunger design of FIGS. 13 and 14 are similar to that described above with the stepped plunger and cup design, wherein the stroke of the lower plunger 328 is such that the lowermost edge of the minor diameter section 362 is raised to just be within greater diameter first portion 376 of the inner wall 366 of the cup 316 during metering. Thus, a compromise design is shown including all of the advantages of the stepped plunger and cup design, although somewhat lessened, while allowing reduced manufacturing costs and retrofitting of injectors already in existence. Moreover, the sensitivity to carboning is reduced as to the metering of fuel by the limiting effect of the stepped radial gap, in a similar manner as the stepped plunger and cup design amplified above.

Figure 16:
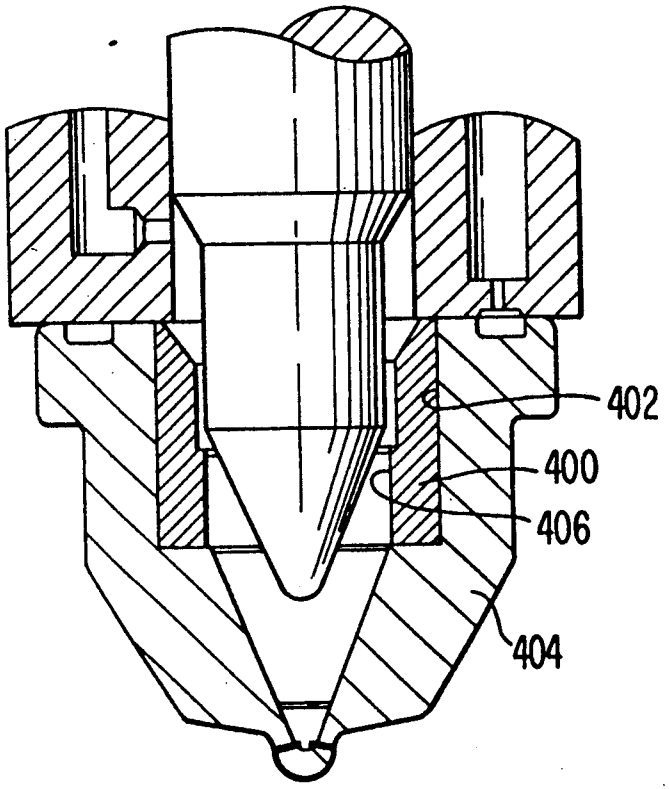
FIG. 16 is a view similar to FIG. 11 with the plunger in the retracted position corresponding to the metering stage.
Figure 15:
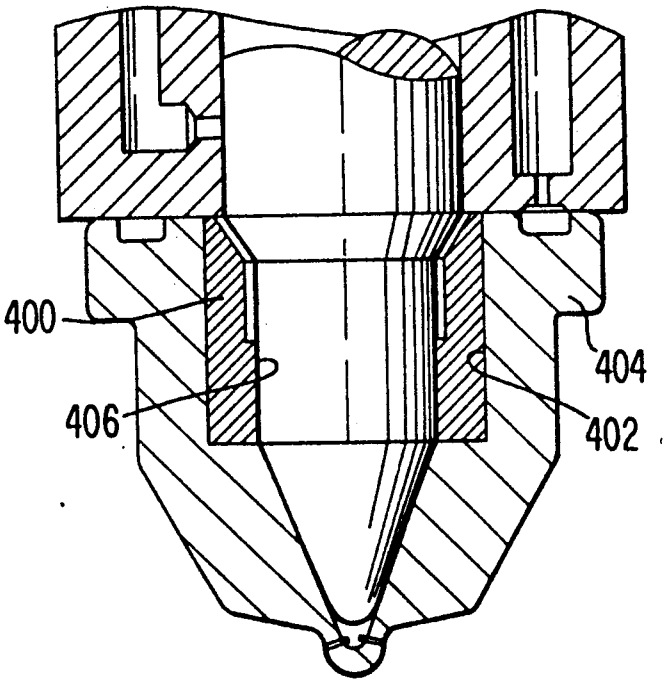
FIG. 15 is a partial cross-sectional view of an open nozzle fuel injector formed in accordance with the present invention that is further modified to include an insert within the cup to define the inner wall of the cup, with the plunger in the advanced position just after injection.

A further modification that may be applied to any of the above described embodiments but specifically shown as a modification of the FIGS. 13 and 14 embodiment is illustrated in FIGS. 15 and 16. Such a further modification is provided by an insert 400 that is separately manufactured and provided within an enlarged bore 402 of the cup 404. The inner bore 406 of the insert 400 is specifically shown with a stepped design, but it is understood that the insert could be equally used to provide a tapered design as described above. Moreover, the insert can be used with or without a stepped plunger design as also described above. Moreover, the insert can be used for retrofitting non-stepped or non-tapered prior art injector cups that must only then be bored out for retrofitting and use in an open nozzle injector in a way to take advantage of the above described benefits.

Industrial Applicability

It is understood that the above described embodiments and modifications thereof are applicable to all open nozzle type fuel injectors whether the injectors are used in large heavy equipment engines or in smaller engines used in industrial vehicles, equipment, and automobiles. For instance, the known high pressure unit fuel injectors as disclosed in U.S. Pat. No. 4,721,247, that is owned by the assignee of the present application, can be modified in accordance with this invention. These high pressure unit fuel injectors have particular applicability to smaller internal combustion engines having lower compression that are designed for powering automobiles.

We claim:

1. A unit fuel injector comprising:

an injector body with an axial bore and an injection orifice at a lower end of the said injector body, said axial bore defined by a first portion and a second portion positioned at the lower end of said injector body;

fuel metering means for metering a variable quantity of fuel to said axial bore to be injected through said injection orifice on a cyclic basis, the quantity of metered fuel being dependent on the pressure of the fuel supplied to said unit fuel injector;

a plunger means disposed within said axial bore for reciprocable movement in said axial bore between a retracted position and an advanced position, said plunger means including a major diameter section to slidably engage said first portion of said axial bore and a minor diameter section that at least partially extends within said second portion of said axial bore throughout the range of movement of said plunger means between the retracted and advanced positions, wherein a radial gap is provided between said minor diameter section and said second portion of said axial bore thus defining a volume along the extent that said minor diameter section extends within said second portion of said axial bore; and means for modifying said radial gap so that when said plunger means is in the advanced position the radial gap between a lowermost edge of said minor diameter section and said second portion of said axial bore is smaller than the radial gap between the lowermost edge of said minor diameter section and said second portion of said axial bore when said plunger mean is in the retracted position.

2. The fuel injector of claim 1, wherein said first portion of said axial bore is of a substantially constant diameter and said fuel metering means includes a supply port opening to said first portion of said axial bore.

3. The fuel injector of claim 2, wherein said injector body comprises a barrel and a cup which are positioned end to end with said axial bore extending through said barrel and into said cup, said second portion of said bore is provided in said cup, and said injection orifice passes through a nozzle of said cup.

4. The fuel injector of claim 3, wherein said second portion of said axial bore is smaller in diameter than said first portion of said axial bore, and said minor diameter section of said plunger means is smaller in diameter than said major diameter section of said plunger means.

5. The fuel injector of claim 4, wherein said means for modifying said radial gap includes a means for changing the diameter of said second portion of said axial bore within said cup.

6. The fuel injector of claim 5, wherein said means for changing the diameter of said second portion of said axial bore defines an inner wall of said cup with a smaller diameter at an end of said second portion of said axial bore nearest said injection orifice than at an end of said second bore of said axial bore adjacent said barrel.

7. The fuel injector of claim 6, wherein said means for modifying the radial gap further includes a means for changing the diameter of said minor diameter section of said plunger means.

8. The fuel injector of claim 7, wherein said means for changing the diameter of said minor diameter section of said plunger means defines an outer surface of said minor diameter section with a smaller diameter at the lowermost edge than at an uppermost edge adjacent said major diameter section of said plunger means.

9. The fuel injector of claim 6, wherein said inner wall of said cup includes at least two substantially constant diameter sections with an annular step therebetween, and said reciprocable movement of said plunger means between said retracted and advanced positions takes place over an axial stroke, said axial stroke being larger than an axial length of a lowermost one of said substantially constant diameter sections of said inner wall of said cup.

10. The fuel injector of claim 8, wherein said inner wall of said cup includes at least two substantially constant diameter sections with an annular step therebetween, and said reciprocable movement of said plunger means between said retracted and advanced positions takes place over an axial stroke, said axial stroke being larger than an axial length of a lowermost one of said substantially constant diameter sections of said inner wall of said cup.

11. The fuel injector of claim 10, wherein said outer surface of said minor diameter section of said plunger means includes at least two substantially constant diameter sections with an annular step therebetween of a like number as there are substantially constant diameter sections on said inner wall of said cup.

12. The fuel injector of claim 11, wherein said radial gap between each of said substantially constant diameter sections of said inner wall of said cup and said outer surface of said minor diameter section are substantially equal when said plunger means in it the advanced position.

13. The fuel injector of claim 8, wherein said inner wall of said cup is tapered to decrease the diameter of said second portion of said axial bore toward said injection orifice.

14. The fuel injector of claim 13, wherein said outer surface of said minor diameter section of said plunger means is tapered to decrease the diameter of said minor diameter section toward said lowermost edge.

15. The fuel injector of claim 6, wherein said means for modifying said radial gap further includes an insert fitted within an enlarged bore of said cup, said insert having said second portion of said axial bore and said inner wall defined therein, and said inner wall is composed of a carbon resistant material.

16. The fuel injector of claim 15, wherein said inner wall is provided as carbon resistant by superfinishing the inner wall.

17. A unit fuel injector comprising:

an injector body with an axial bore and an injection orifice at a lower end of the said injector body, said axial bore defined by a first portion and a second portion positioned at the lower end of said injector body;

fuel metering means for metering a variable quantity of fuel to said axial bore to be injected through said injection orifice on a cyclic basis, the quantity of metered fuel being dependent on the pressure of the fuel supplied to said unit fuel injector;

a plunger means disposed within said axial bore for reciprocable movement in said axial bore between a retracted position and an advanced position, said plunger means including a major diameter section to slidably engage said first portion of said axial bore and a minor diameter section that at least partially extends within said second portion of said axial bore throughout the range of movement of said plunger means between the retracted and advanced positions, wherein a radial gap is provided between said minor diameter section and said second portion of said axial bore thus defining a volume along the extent that said minor diameter section extends within said second portion of said axial bore; and means for modifying said radial gap so that when said plunger means is in the advanced position the radial gap between a lowermost edge of said minor diameter section and said second portion of said axial bore is smaller than the radial gap between the lowermost edge of said minor diameter section and said second portion of said axial bore when said plunger means is in the retracted position, said means for modifying said radial gap includes an inner wall of said cup with a smaller diameter at an end of said second portion of said axial bore nearest said injection orifice that at an end adjacent said first portion of said axial bore.

18. The fuel injector of claim 17, wherein said means for modifying the radial gap further includes a means for changing the diameter of said minor diameter section of said plunger means.

19. The fuel injector of claim 18, wherein said means for changing the diameter of said minor diameter section of said plunger means defines an outer surface of said minor diameter section with a smaller diameter at the lowermost edge than at an uppermost edge adjacent said major diameter section of said plunger means.

20. The fuel injector of claim 19, wherein said inner wall of said cup includes at least two substantially constant diameter sections with an annular step therebetween, and said reciprocable movement of said plunger means between said retracted and advanced positions takes place over an axial stroke, said axial stroke being larger than an axial length of a lowermost one of said substantially constant diameter sections of said inner wall of said cup.

21. The fuel injector of claim 20, wherein said outer surface of said minor diameter section of said plunger means includes at least two substantially constant diameter sections with an annular step therebetween of a like number as there are substantially constant diameter sections on said inner wall of said cup.

22. The fuel injector of claim 21, wherein said radial gap between each of said substantially constant diameter sections of said inner wall of said cup and said outer surface of said minor diameter section are substantially equal when said plunger means in it the advanced position.

23. The fuel injector of claim 19, wherein said inner wall of said cup is tapered to decrease the diameter of said second portion of said axial bore toward said injection orifice.

24. The fuel injector of claim 23, wherein said outer surface of said minor diameter section of said plunger means is tapered to decrease the diameter of said minor diameter section toward said lowermost edge.

25. The fuel injector of claim 17, wherein said means for modifying said radial gap further includes an insert fitted within an enlarged bore of said cup, said insert having said second portion of said axial bore and said inner wall defined therein, and said inner wall is composed of a carbon resistant material.

26. The fuel injector of claim 25, wherein said inner wall is provided as carbon resistant by superfinishing the inner wall.

27. A unit fuel injector comprising:

an injector body with an axial bore and an injection orifice at a lower end of the said injector body, said axial bore defined by a first portion and a second portion positioned at the lower end of said injector body;

fuel metering means for metering a variable quantity of fuel to said axial bore to be injected through said injection orifice on a cyclic basis, the quantity of metered fuel being dependent on the pressure of the fuel supplied to said unit fuel injector;

a plunger means disposed within said axial bore for reciprocable movement in said axial bore between a retracted position and an advanced position, said plunger means including a major diameter section to slidably engage said first portion of said axial bore and a minor diameter section that at least partially extends within said second portion of said axial bore throughout the range of movement of said plunger means between the retracted and advanced positions, wherein a radial gap is provided between said minor diameter section and said second portion of said axial bore thus defining a volume along the extent that said minor diameter section extends within said second portion of said axial bore; and means for modifying said radial gap so that when said plunger means is in the advanced position the radial gap between a lowermost edge of said minor diameter section and said second portion of said axial bore is smaller than the radial gap between the lowermost edge of said minor diameter section and said second portion of said axial bore when said plunger means is in the retracted position, said means for modifying said radial gap includes an inner wall of said cup with a smaller diameter at an end of said second portion of said axial bore nearest said injection orifice than at an end adjacent said first portion of said axial bore, and an outer surface of said minor diameter section of said plunger means with a smaller diameter at the lowermost edge than at an uppermost edge adjacent said major diameter section of said plunger means.

* * * * *